US005325875A

United States Patent [19]

Coleman et al.

[11] Patent Number: 5,325,875

[45] Date of Patent: * Jul. 5, 1994

[54] APPARATUS FOR SEPARATING THRESHED LEAF TOBACCO

[75] Inventors: G. A. John Coleman; William C. Lacy, Jr., both of Richmond, Va.

[73] Assignee: Universal Leaf Tobacco Co., Inc., Richmond, Va.

[ * ] Notice: The portion of the term of this patent subsequent to Mar. 31, 2009 has been disclaimed.

[21] Appl. No.: 804,741

[22] Filed: Dec. 11, 1991

Related U.S. Application Data

[63] Continuation-in-part of Ser. No. 591,054, Oct. 1, 1990, Pat. No. 5,099,863, which is a continuation-in-part of Ser. No. 88,390, Aug. 24, 1987, abandoned, and a continuation-in-part of Ser. No. 304,267, Jan. 31, 1989, abandoned.

[51] Int. Cl.[5] ..... A24B 3/16

[52] U.S. Cl. ..... 131/109.2; 131/312; 209/136; 209/138

[58] Field of Search ..... 131/108, 109.1, 109.2, 131/110, 312; 209/136, 138

[56] References Cited

U.S. PATENT DOCUMENTS

| | | |
|---|---|---|
| 518,082 | 4/1894 | Stuckey et al. . |
| 974,395 | 11/1910 | Kidder . |
| 1,530,277 | 3/1925 | Mettler, Sr. . |
| 1,863,666 | 6/1932 | Lorentz . |
| 1,903,931 | 4/1933 | Molins et al. . |
| 1,962,668 | 6/1934 | Olney . |
| 2,130,880 | 9/1938 | Durning . |

(List continued on next page.)

FOREIGN PATENT DOCUMENTS

| | | |
|---|---|---|
| 0483698 | 11/1974 | Australia . |
| 0630756 | 6/1936 | Fed. Rep. of Germany . |
| 0828904 | 6/1938 | France . |
| 0047566 | 1/1940 | Netherlands . |
| WO90/14020 | 11/1990 | PCT Int'l Appl. . |
| 746106 | 3/1956 | United Kingdom . |
| 0755252 | 8/1956 | United Kingdom . |
| 1167866 | 10/1969 | United Kingdom . |

OTHER PUBLICATIONS

"Jobson FB Separator designed to shorten tobacco threshing line" Dec. 23, 1988 (no author listed).

"New Threshing Line Offers Cost, Noise and Space Benefits" by the Cardwell Machine Company.

"Single Pass Classifier Reduces Leaf Degradation" from Tobacco reporter, Apr. 1985.

*Primary Examiner*—Jennifer Bahr

*Attorney, Agent, or Firm*—Cushman, Darby & Cushman

[57] ABSTRACT

Apparatus for separating lighter particles such as lamina containing little or no stem from tobacco particles contained in threshed leaf tobacco which comprises a plurality of tobacco particle separating units, each including a separation chamber each a fan system for establishing a generally upward air flow therein. A tobacco particle projecting mechanism is provided in each chamber for projecting tobacco particles across the generally upward air flow therein with each having structure for directing tobacco particles in cooperating relation therewith to be projected thereby. Mechanisms are provided for receiving the lighter particles carried upwardly by the air flow, the heavier particles moving downwardly within the air flow within each chamber and discharging the particles therefrom. The plurality of tobacco particle separating units are mounted in side-by-side relation in a row which includes an initial end unit and a final end unit with the tobacco particle directing structure of the initial end unit arranged to receive a supply of threshed leaf tobacco and the tobacco particle directing structure of the remaining of the plurality of units being directly connected to receive tobacco particles through a tobacco particle opening in the receiving side of the chamber of the preceding unit so that the tobacco particles projected across the chamber of the preceding unit which move across the air flow therein and pass through the opening form a tobacco particle supply directed to an associated projecting mechanism by an associated tobacco particle directing structure.

11 Claims, 8 Drawing Sheets

U.S. PATENT DOCUMENTS 2,173,088 9/1939 Eissmann .
2,275,849 3/1942 Fraser .
2,658,617 11/1953 Rowell .
2,667,174 1/1954 Eissmann .
2,825,457 3/1958 Rowell .
2,852,137 9/1958 Hagopian .
2,941,667 6/1960 Hilgartner, Jr. et al. .
2,944,629 7/1960 Eissmann .
2,988,213 6/1961 Davis et al. .
3,010,576 11/1961 Harte et al. .
3,034,646 5/1962 Eissmann et al. .
3,074,413 1/1963 McArthur .
3,092,117 6/1963 Labbe .
3,164,548 1/1965 Rowell et al. .
3,200,947 8/1965 Wochnowski .
3,240,335 3/1966 Vandenhoeck .
3,265,209 8/1966 Wochnowski et al. .
3,308,950 3/1967 Harte et al. .
3,360,125 12/1967 Horsey .
3,362,414 1/1968 Wochnowski .
3,378,140 4/1968 Wochnowski et al. .
3,397,782 8/1968 Kwong et al. .
3,443,688 5/1969 Molins .
3,542,037 11/1970 Pietralunga .
3,593,851 7/1971 Davidson .
3,608,716 9/1971 Rowell et al. .
3,655,043 4/1972 Wochnowski et al. .
3,727,755 4/1973 Cristiani .
3,986,949 10/1976 Di Duca et al. .
4,003,385 1/1977 Adebahr et al. .
4,045,334 8/1977 Ferrary et al. .
4,213,852 7/1980 Etkin .
4,253,940 3/1981 Price .
4,405,451 9/1983 Roman .
4,411,038 10/1983 Mukai .
4,465,194 8/1984 Coleman .
4,475,562 10/1984 Thatcher et al. .
4,618,415 10/1986 Vecchio et al. .
4,701,256 10/1987 Cross .
4,755,284 7/1988 Brooks et al. .
4,915,824 4/1990 Surtees .
4,932,423 6/1990 Lauenstein et al. ..... 131/110
5,099,863 3/1992 Coleman ..... 131/312
5,205,415 4/1993 Surtees .

APPARATUS FOR SEPARATING THRESHED LEAF TOBACCO

This application is a continuation-in-part of my U.S. application No. 07/591,054, filed Oct. 1, 1990, issued Mar. 31, 1992, U.S. Pat. No. 5,099,863, entitled "Apparatus for Separating Threshed Leaf Tobacco" which, in turn, is a continuation-in-part of my U.S. application No. 07/088,390, filed Aug. 24, 1987, now abandoned, and a continuation-in-part of my U.S. application No. 07/304,267, filed Jan. 31, 1989, now abandoned.

The invention relates to apparatus for separating threshed leaf tobacco, and more particularly to apparatus of this type which will improve the separation characteristics while minimizing damage to the lamina particles.

The invention is particularly concerned with the separation of threshed tobacco leaves by air stream separation into (1) lighter particles such as lamina with little or no stem, and (2) heavier particles such as stem with or without attached lamina. Air flotation type separation apparatus is known, and basically includes a separation chamber having opposed sides and a closed fan system for establishing a generally upward flow of air within the chamber between the sides thereof. Successive particles from a supply of threshed leaf tobacco are projected from one side of the chamber across the chamber so that (1) lighter particles are carried upwardly by the airflow within the chamber, and (2) heavier particles move by gravity downwardly through the airflow within the chamber. A discharge system is provided in the upper portion of the chamber for receiving the upwardly carried lighter particles and discharging them from the chamber, and a separate discharge system is provided in the lower portion of the chamber for receiving the heavier particles moving downwardly by gravity and discharging the same from the chamber.

In my U.S. Pat. No. 4,465,194, there is disclosed an apparatus of this type in which means is provided for further handling and separating projected particles which travel entirely across the chamber and for effecting a final separation of lighter particles entrained with the particles received in the heavier particle discharge system. The lighter particles separated in the apparatus are frequently subsequently shredded into a form useful in cigarettes.

In the use of apparatus of the type herein contemplated, it is often the case that the heavier particle fraction discharging from the apparatus contains lighter particles clumped therewith which did not get separated in the operation of the apparatus. Consequently, it is often the practice to set up an intervening power-operated system for delivering the heavier particle discharge from one apparatus to the inlet of a similar apparatus as the threshed leaf tobacco supply thereof. In this way, a better final separation can be achieved. However, due to the additional handling by the intervening power-operated system, it is achieved in a manner which tends to effect damage to the lamina. It has also been the practice heretofore to form a stack of two separators of the type disclosed in the '194 patent wherein the discharge of the upper separator is disposed in immediate gravity feeding relation with the inlet of the lower separator. However, the stacked relationship is undesirable because it is generally limited to two separators and the upper one is difficult to control and maintain. There is, therefore, a need to provide an apparatus of the type described capable of cooperating in side-by-side relation with a similar apparatus without the need to provide a lamina-damaging intervening power-operated system.

Accordingly, it an object of the present invention to provide a single apparatus which will fulfill the above-described need. In accordance with the principles of the present invention, this objective is obtained by providing an apparatus for separating lighter particles from heavier particles in a mixture thereof which comprises a plurality of successive side-by-side separation chambers constructed and arranged to enable particles to be continuously moved therethrough from an initial end chamber downstream to a final end chamber. Each of the chambers has a pair of opposite sides one of which is a projecting side and one of which is a receiving side with the receiving side of each chamber upstream of the final end chamber having an opening therein in immediate feed communicating relation with the projecting side of the next downstream chamber. A fan system is constructed and arranged with respect to the chambers to establish a generally upward air flow in each of the plurality of separation chambers between the opposite sides thereof. A power driven particle projecting mechanism associated with each chamber is disposed in the projecting side of the associated chamber. The power driven particle projecting mechanism associated with the initial end chamber is constructed and arranged to project particles of a mixture fed thereto into and across the generally upward air flow in the initial end chamber so that lighter particles are carried upwardly by the generally upward air flow within the initial end chamber and some particles including heavier particles move downwardly within the generally upward air flow in the initial end chamber. The power driven particle projecting mechanism associated with each chamber downstream of the initial end chamber is constructed and arranged to project particles fed thereto into and across the generally upward air flow in the associated downstream chamber so that lighter particles are carried upwardly by the generally upward air flow within the associated downstream chamber and some particles including heavier particles move downwardly within the generally upward air flow in the associated downstream chamber. The power driven particle projecting mechanism associated with each chamber downstream of the initial end chamber is constructed and arranged with respect to the adjacent upstream chamber so as to be disposed in immediate feed communicating relation with the opening in the receiving side of the adjacent upstream chamber. The power driven particle projecting mechanism associated with each chamber upstream of the final end chamber is constructed and arranged to project the particles fed thereto into and across the generally upward air flow in each upstream chamber in such a way that some particles reach the receiving side of each upstream chamber in a position to enter the opening therein in immediate feed communicating relation with the adjacent downstream power driven particle projecting mechanism so as to be immediately projected thereby into and across the generally upward air flow in the chamber associated therewith. A lighter particle receiving and moving assembly is constructed and arranged with respect to the chambers to receive the lighter particles carried upwardly by the generally upward air flow within the chambers and move the same in such a way as to enable the lighter particles to be discharged from the chambers. A heavier particles receiving and moving assembly is constructed and arranged with respect to the chambers to receive the particles including heavier particles which move downwardly within the generally upward air flow in the chambers and move the same in such a way as to enable them to be discharged from the chambers.

Another object of the present invention is the provision of an apparatus of the type described in which the heavy particle receiving and moving assembly constitutes an upper flight of a separate endless foraminous conveyor in each chamber. The separate endless foraminous conveyor in each chamber upstream of the final end chamber being constructed and arranged such that the upper flight moves the particles received thereon in such a way as to be discharged into the opening in the receiving side thereof. The separate endless foraminous conveyor in the final end chamber is constructed and arranged such that the upper flight moves the particles received therein in such a way as to be discharged into an outlet at the receiving side thereof.

The provision of a separate endless foraminous conveyor in each chamber upstream of the final end chamber constructed and arranged as indicated above is advantageous in that lighter particles which may be entrained with heavier particles received on the separate endless foraminous conveyors are immediately projected across the generally upward air flow in the next downstream chamber thereby presenting the possibility that such entrained lighter particles may be set free to be received by the lighter particle receiving and moving assembly of the next downstream chamber.

Another object of the present invention is to provide a method of separating lighter particles from heavier particles in a mixture thereof utilizing a plurality of successive side-by-side separation chambers for continuous movement of particles therethrough from an initial end chamber downstream to a final end chamber. Each of the chambers has a pair of opposite sides one of which is a projecting side and one of which is a receiving side with the receiving side of each chamber upstream of the final end chamber having an opening therein which is disposed in immediate feed communicating relation with the projecting side of the next downstream chamber. A generally upward air flow is established in each of the plurality of separation chambers between the opposite sides thereof. Particles from the projecting side of each chamber are projected into and across the generally upward air flow therein so that lighter particles are carried upwardly by the generally upward air flow in each chamber and particles including heavier particles move downwardly through the generally upward air flow in each chamber, the particles projected from the projecting side of the initial end chamber being the lighter and heavier particles of the mixture. Some of the particles are caused to be projected from the projecting side of each chamber upstream of the final end chamber to reach the receiving side thereof and to pass through the opening therein to immediately become particles projected from the projecting side of the next downstream chamber into and across the generally upward air flow in the next downstream chamber. The lighter particles are carried upwardly by the air flow within the chamber and moved in such a way as to enable them to be discharged from the chambers. The particles including heavier particles which move downwardly within the generally upwardly air flow are received in the chambers and moved in such a way as to enable them to be discharged from the chambers.

Another object of the present invention is the provision of a method of the type described where threshed leaf tobacco constitutes the particle being separated and wherein the particles including the heavier particles which move downwardly through the generally upward air flow in each chamber upstream of the final end chamber are received in each upstream chamber and moved in such a way as to be discharged into the opening in the receiving side of each upstream chamber to immediately become particles projected from the projecting side of the next downstream chamber. The particles include heavier particles which move downwardly through the generally upward air flow in the final end chamber and are received therein and moved in such a way as to be discharged through an outlet at the receiving side thereof.

The above object and other objects of the present invention will become more apparent during the course of the following detailed description and appended claims.

The invention may best be understood with reference to the accompanying drawings wherein an illustrative embodiment is shown.

IN THE DRAWINGS

Figure 1:
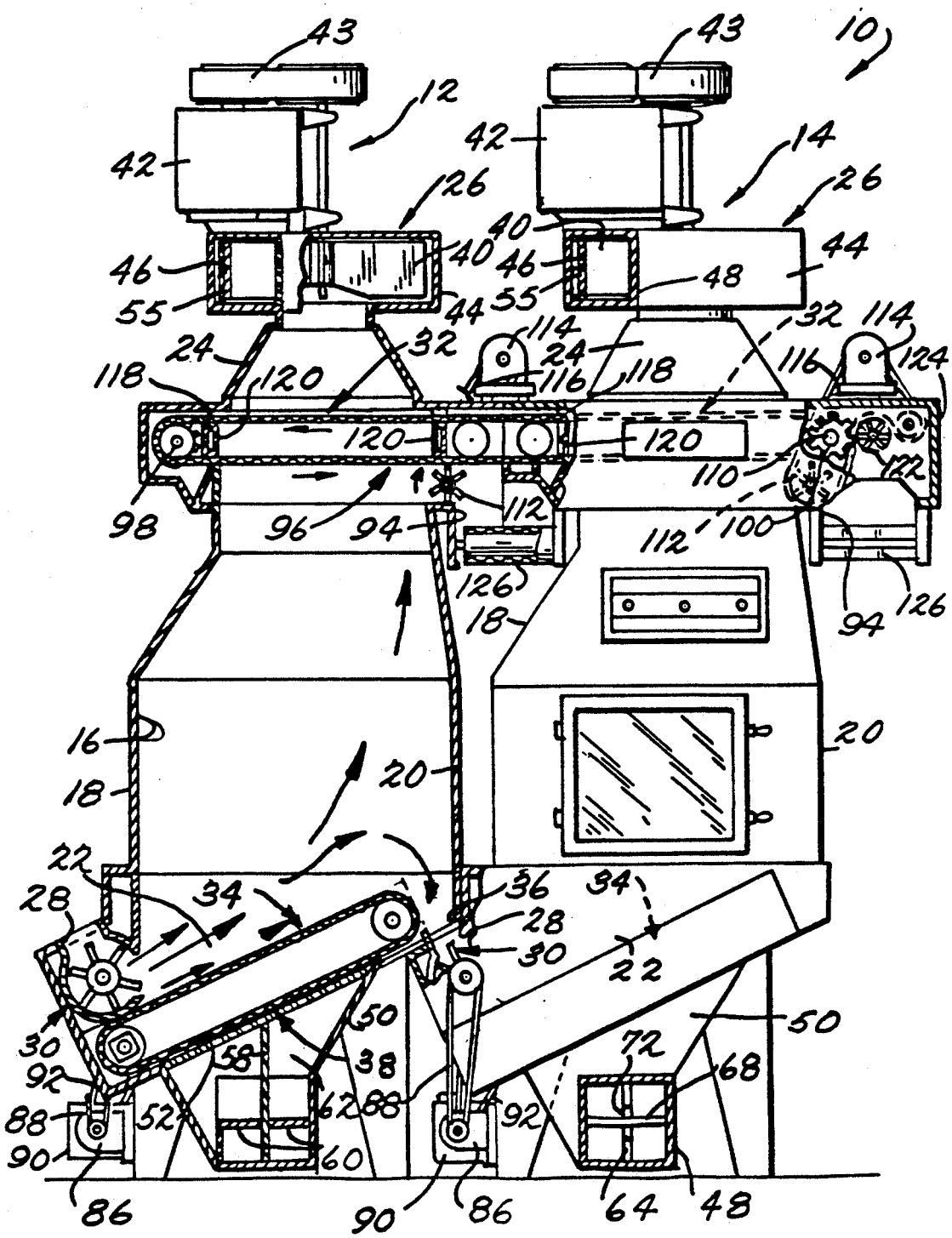
FIG. 1 is a front elevational view of one embodiment of an apparatus embodying the principles of the present invention with certain parts broken away for purposes of clear illustration.

Referring now more particularly to the drawings, there is shown therein an apparatus, generally indicated at 10, for separating threshed leaf tobacco into (1) lighter particles such as lamina containing little or no stem, and (2) heavier particles such as lamina with attached stem or naked stems. The apparatus 10 includes two separation devices, generally indicated at 12 and 14, which are of similar construction. Each separation device 12 and 14 is capable of operating alone or in cooperating side-by-side relation with a similar device. Thus, while two separation devices 12 and 14 are shown, it will be understood that the invention contemplates that the apparatus 10 can include more than two similar separation devices.

Set forth below is a description of the structure of the separation device 12 and its mode of operation (1) alone and (2) in conjunction with the similar separation device 14. It will be understood that, since the separation devices 12 and 14 are similar, a description of separation device 12 will be sufficient to provide an understanding of the construction and operation of the separation device 14. Accordingly, the same reference numerals utilized in the description of separation device 12 will be applied to separation device 14.

As shown, the separation device 12 provides a housing structure defining a separation chamber 16 having a tobacco projecting side 18, an opposite tobacco receiving side 20, a lower air inlet end 22, and an upper air outlet end 24.

A variable plural path fan circulating system, generally indicated at 26, is mounted exteriorly of the separation chamber 16 with its suction side connected with the upper air outlet end 24 thereof and the pressure side connected with the lower air inlet end thereof. The fan system 26 is operable to establish a generally upward flow of air within the separation chamber 16.

Mounted in the tobacco inlet side 18 of the separation chamber 16 is an inlet 28 for receiving a supply of threshed leaf tobacco downwardly therethrough. The inlet 28 delivers the supply of threshed leaf tobacco downwardly into cooperating relation with a threshed leaf tobacco projecting mechanism, generally indicated at 30, operable to project the supply of threshed leaf tobacco from the tobacco inlet side 18 of the separation chamber 16 toward the opposite tobacco outlet side 20 thereof, so that (1) lighter particles are carried upwardly by the flow of air within the separation chamber 16, and (2) heavy particles move by gravity downwardly through the flow of air within the separation chamber 16.

A lighter particle receiving and discharging system, generally indicated at 32, is provided in the upper air outlet end 24 of the separation chamber 16 for receiving the lighter particles carried upwardly by the flow of air within the separation chamber and discharging the lighter particles therefrom. Lighter particle receiving and discharge system may also be any known centrifugal device commonly used in the tobacco industry. A heavier particle receiving and discharging system, generally indicated at 34, is provided in the lower air inlet end 22 of the separation chamber 16 for receiving some of the heavier particles moving by gravity downwardly with the upward air flow and discharging them from the separation chamber 16. Most of the heavier particles contact the receiving wall 20 and fall by gravity directly into the outlet 36.

In accordance with the principles of the present invention, the discharging means of the system 34 is an outlet 36 formed in the outlet side 20 of the separation chamber 16 for receiving heavier particles downwardly therethrough. It will be noted that the lower end of the outlet 36 is at a vertical level slightly above the vertical level of the upper end of the inlet 28 so as to deliver the heavier particles downwardly from the outlet 36 directly into the inlet 28 of a similar device, such as the device 14. The heavier particle receiving and discharging system 34 also preferably includes an endless foraminous conveyor mechanism, generally indicated at 38, having openings of a size (1) to enable the upward air flow to pass therethrough and (2) to receive and prevent passage of heavier particles therethrough. The conveyor mechanism 38 is operable to deliver heavier particles received thereon downwardly into the outlet 36.

It will also be noted that the outlet 36 is disposed in a position to receive threshed leaf tobacco projected by the threshed leaf tobacco projecting system 30 which has not been (1) carried upwardly by the air flow in the separation chamber 16 and received as lighter particles by the lighter particle receiving and discharging system or (2) moved downwardly through the upward air flow in the separation chamber and received as heavier particles by the heavier particle conveyor mechanism 38.

The separation chamber 16 may be formed of any desirable construction. In the drawings, the separation chamber 16 is schematically illustrated to be formed of sheet metal. It will be understood that a rigid framework for retaining the sheet metal (not shown) normally would be provided. As shown, the separation chamber 16 is of generally rectangular configuration with the lower portion being somewhat enlarged, and the upper portion being generally of upwardly tapering design configuration which aids in separating the lighter particles by increasing the velocity of the upward air flow as it passes therethrough.

The fan circulating or airflow establishing system 26, as shown, includes a fan blade assembly 40, suitably journalled for rotational movement about a vertical axis within a housing of conventional fan configuration. The fan blade assembly 40 is driven by a suitable variable speed motor 42 through a suitable motion transmitting mechanism, such as a belt and pulley assembly 43. The fan housing includes an arcuate peripheral wall 44 which extends somewhat less than 360° so as to provide for a tangential discharge chute 46 which constitutes the pressure side of the fan blade assembly 40. The lower end of the suction side of the fan blade assembly 40 communicates directly with the upper end of the upper air outlet end 24 of the separation chamber 16, and a top wall of the fan section closes the upper end thereof.

Figure 3:
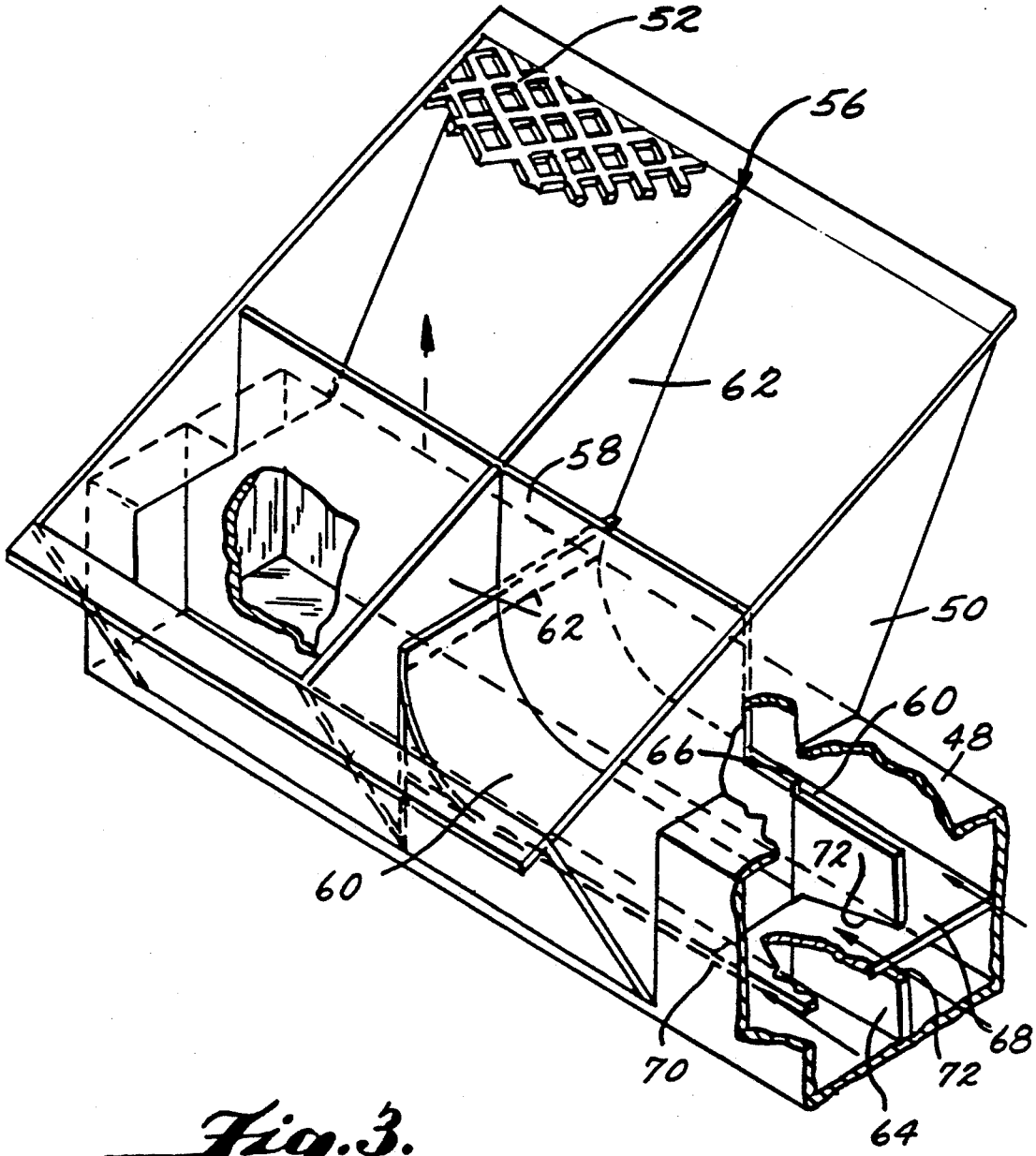
FIG. 3 is an isometric view illustrating the system for dividing the lower inlet end of each separation device into a plurality of separate flow paths and for varying the amount of air directed to each separate flow path, the view being shown with parts broken for purposes of clear illustration.

The tangential discharge 46 of the fan blade assembly 40 is connected with the upstream end of a generally vertically elongated C-shaped main pressure side duct section 48, the downstream horizontal end portion of which connects with the upstream end of a downstream outlet duct section 50 which has a downstream ending just below the endless heavier particle conveyor mechanism 38 and which discharges thereto through a suitable perforated or apertured diffusing plate or screen 52, such as shown in FIG. 3.

Figure 2:
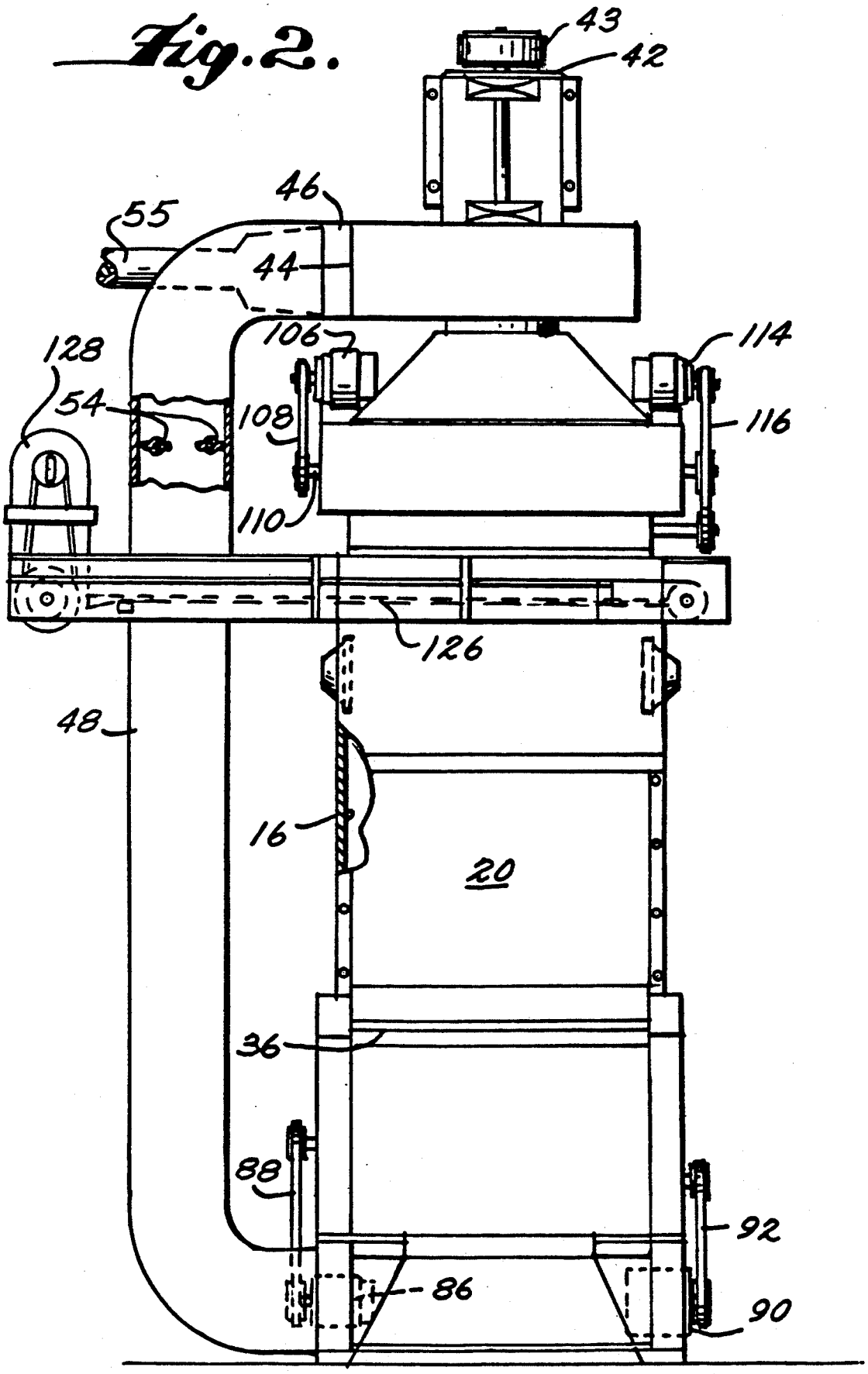
FIG. 2 is an elevational view of the apparatus taken from the outlet side thereof, with certain parts broken away for purposes of clear illustration.

As best shown in FIG. 2, the main pressure side duct section 48 includes adjustable dampers 54 which can be used for controlling the amount of flow in the duct section downstream thereof in lieu of the variable speed fan motor 42. Moreover, a bleed off duct section 55 is provided at the tangential discharge chute 46 so as to bleed off about 10% of the full capacity of the fan to maintain a negative pressure on the system and remove dust for product and environmental purposes. It will be understood that a manually controlled fresh air inlet (not shown) may be provided in the system 26 preferably on the suction side of the fan 40.

Referring now more particularly to FIG. 3, there is shown therein an adjustable air flow dividing system, generally indicated at 56. As shown, the system 56 includes a vertically extending divider wall 58 having an upstream end within the horizontal downstream end portion of the main duct section 48 and a downstream end which terminates just below the diffusing plate 52. The diffusing plate 52, like the conveyor 38, slopes upwardly from the inlet side 18 of the separation chamber 16 to the outlet 36 therein adjacent the outlet side 20. The outlet duct section 50 diverges upwardly in a direction toward the inlet and outlet sides of the separation chamber 16. The vertical divider wall 58 divides the full flow within the main duct section 48 into two divided paths one at the inlet side 18 of the separation chamber 16 and the other at the outlet side 20 thereof.

The system 56 also includes a pair of divider walls 60 on opposite sides of the vertical divider wall which divides each of the aforesaid two paths into two paths. The horizontal divider walls 60 extending horizontally from their upstream ends adjacent the upstream end of the vertical wall 58 and curve upwardly at the downstream ends into abutting relation to a pair of vertical divider walls 62. The divider walls 58, 60 and 62 thus serve to divide the full air flow within the main duct section 48 into four separate air flow paths which are in quadrant formation at the downstream end thereof at the diffusing plate 52.

The system 56 includes means at the upstream end of these four separate flow paths for varying the proportion of the full air flow within the main duct section 48 which is directed to the four separate paths. FIG. 3 illustrates the flow proportion varying means as including a vertical vane 64 pivoted, as at 66, adjacent the upstream end of the vertical divider wall 58 and a horizontal vane 68 pivoted, as at 70, adjacent the upstream end of the horizontal divider walls 60. In order to accommodate the horizontal vane 68, the vertical vane has an angular section 72 removed therefrom.

Figure 4:
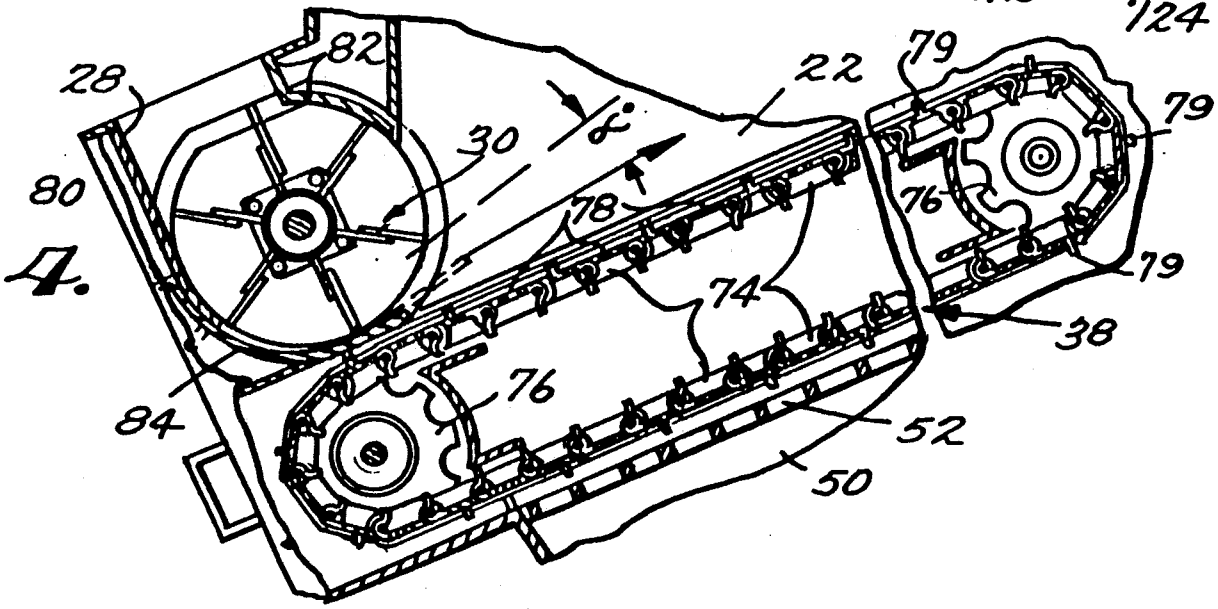
FIG. 4 is an enlarged fragmentary sectional view illustrating the inlet and adjustable tobacco projecting system of the present apparatus.

Referring now more particularly to FIG. 4, it will be noted that the heavier particle endless foraminous conveyor 38 which is illustrated schematically as an endless screen type conveyor in FIG. 1 preferably is an endless conveyor of the type which includes a pair of transversely spaced endless chains 74 each trained about a pair of sprocket wheels 76 and a plurality of perforated metal slats 78 pivotally interconnected, as by piano hinges, and extending transversely between the links of the chains. The perforations in the slats enable the flow of air upwardly therebetween, first through a lower return flight and then upwardly through an upper operative flight. The size of the perforations in the slats 78 is such that heavier particles moving downwardly within the upward air flow as it enters into the lower air inlet end 22 of the separation chamber 16 cannot pass therethrough. In this way, heavier particles received on the upper operative flight of the endless foraminous conveyor 38 will be carried thereon toward a discharge position above the outlet 36, as the endless conveyor passes over the outlet side sprocket wheel 76. Every second slat 78 has a metal cleat 79 on the outside to lift and carry the heavy particles which come into contact with the conveyor.

FIG. 4 also shows that the inlet 28 for the threshed leaf tobacco supply is defined by spaced walls 80 and 82. The wall 80 has its lower end portion curved to form part of a peripheral housing for the threshed leaf tobacco projecting mechanism which preferably is in the form of a paddle wheel type rotary winnower 30. An adjustable peripheral wall section 84 is disposed in cooperating relation with the curved portion of the wall 80 and includes a tangential discharge end which serves to determine the direction that the threshed leaf tobacco is projected from the inlet side 18 of the separation chamber toward the outlet side 20 thereof. The discharging wall section 84 is adjustable about the axis of rotation of the rotary winnower 30 through a limited angular range so as to adjust the angle of projection. Finally, it will be noted that wall 82 provides a fixed peripheral wall section for the winnower 30. The construction of the inlet 28 is therefore to direct the supply of threshed leaf tobacco received downwardly therein, downwardly into cooperating relation with the winnower 30.

As shown in FIGS. 1 and 2, the rotary winnower 30 is driven by a suitable variable speed motor 86 through a suitable motion transmitting mechanism such as belt and pulley assembly 88. A fixed speed motor 90 is also provided for driving the endless foraminous conveyor 38 through a suitable motion transmitting assembly, such as belt and pulley assembly 92.

Figure 5:
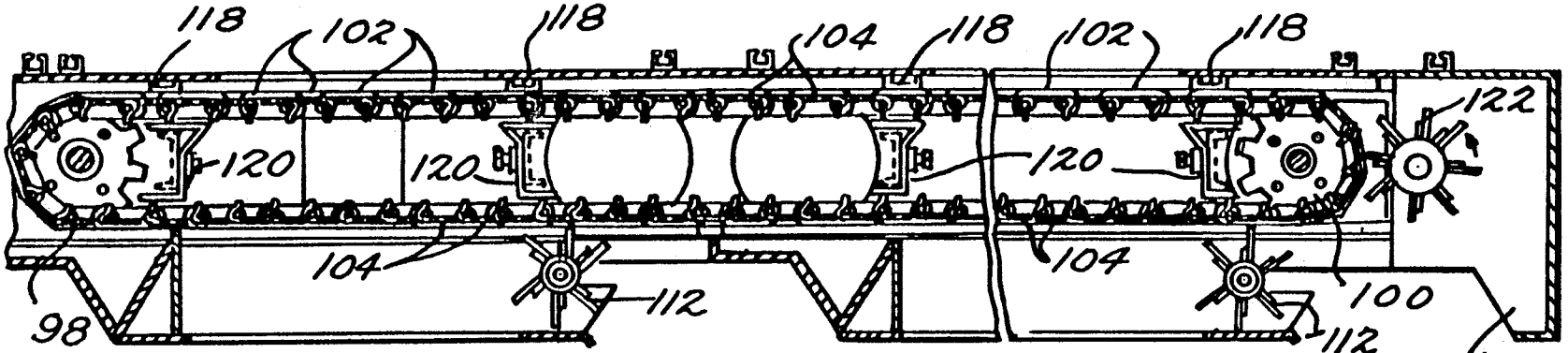
FIG. 5 is an enlarged fragmentary sectional view showing the lighter particle receiving and discharging mechanism of the apparatus of the present invention.

Referring now more particularly to FIGS. 1 and 5, a preferred lighter particle receiving and discharging system 32 is shown. It will be understood that lighter particle receiving and discharge system may also be any known centrifugal device commonly used in the tobacco industry. However, the preferred embodiment shown includes an exit chamber 94 communicating with the outlet side of the associated separation chamber 16 at the upper air outlet end 24 thereof. The lighter particle receiving and discharging system 32 also includes an endless foraminous conveyor, generally indicated at 96, similar to the conveyor 38. Here again, the conveyor 96 is shown schematically in FIG. 1 as an endless screen. It is within the contemplation of the present invention that the conveyor 96 be self contained within each device 12 or 14 in a manner similar to conveyor 38. However, it is preferable that the plural conveyor assemblies 96 be integrated into one. As shown, the device 12 includes laterally spaced structures for mounting laterally spaced pairs of spaced sprocket wheels in each device, one pair of spaced sprocket wheels 98 are mounted in the inlet side 18 of the device 12 and one pair of sprocket wheels 100 are mounted in the outlet side 20 of the device 14. Each sprocket wheel 98 and associated sprocket wheel 100 has a link chain 102 trained thereabout and a series of perforated slats 104 are pivotally interconnected, as by piano hinges and extend transversely between the links of the chains 102 so as to define a lower operative flight extending horizontally through the separation chamber 16 and exit chamber 94, of the device 12 and then through the separation chamber 16 and exit chamber 94 of the device 14. The integrated endless foraminous conveyor 96 is driven by a variable speed motor 106 through a suitable motion transmitting mechanism, such as a belt and pulley system 108 connected with a shaft 110 on which both sprocket wheels 100 are fixed. The motor moves the foraminous conveyor 96 in a direction wherein the lower operative flight moves from left to right as shown in FIGS. 1 and 5. The perforations in the conveyor slats 104 are sufficient to allow for the upward flow of air therethrough and sufficiently small to prevent the movement of lighter particles therethrough. The lamina or lighter particles which move upwardly within the separation chamber 16 by the upward air flow therein are received on the operative flight of the foraminous conveyor 96 for movement therewith from the separation chamber 16 into the adjacent exit chamber 94.

A suitable barrier system is provided for enabling the lower operative flight of the foraminous conveyor 96 with attached lamina to move from each separation chamber 16 into the associated communicating exit chamber 94. As shown, the barrier system includes a power-driven paddle wheel type winnower 112 between the separation chamber 16 and the adjacent exit chamber 94 in a position below the operative flight of the foraminous conveyor 96. The paddle wheel winnower 112 is mounted for power-driven rotation about a horizontal transverse axis by a suitable variable speed motor 114 through a suitable motion transmitting mechanism, such as belt and pulley assembly 116. Each paddle wheel winnower 112 is mounted in a position such that its upper periphery is disposed in cooperating relation with the downwardly facing surfaces of the lower operative flight of the endless foraminous conveyor 96. Each paddle wheel winnower is driven by its motor 114 in a direction such that the upper periphery thereof will move at the speed and in the direction of the operative flight so that lighter particles such as lamina which are moved upwardly in the associated separation chamber 16 by the flow of air therein are caused to move upwardly into engagement with the downwardly facing surfaces of the operative flight of the endless foraminous conveyor 96 by virtue of the direct communication of the suction side of the associated fan blade assembly 40 directly above the operative flight and the associated return flight. These lighter particles which are engaged on the downwardly facing surfaces of the operative flight of the conveyor 96 are thus movable with the operative flight past the associated paddle wheel winnower 112, each of which serves to prevent flow of air between the associated separation chamber 16 and exit chamber 94 at a position below the operative flight. Each barrier system may also include upper baffle members 118 and box-like baffle members 120 between the operative flight and the return flight of the conveyor 96 to block the flow of air therebetween.

Finally, it will be noted that a stripping paddle wheel winnower 122 is mounted in the exit chamber 94 of the device 14 adjacent the leading end of the operative flight therein. The exit chamber 94 of the device 14 is completed by an end structure 124. The winnower 122 is power-driven in an opposite direction to that of the associated winnower 112 so as to strip any lamina that might adhere to the downwardly facing surface of the operative flight of the endless foraminous conveyor 96.

Figure 6:
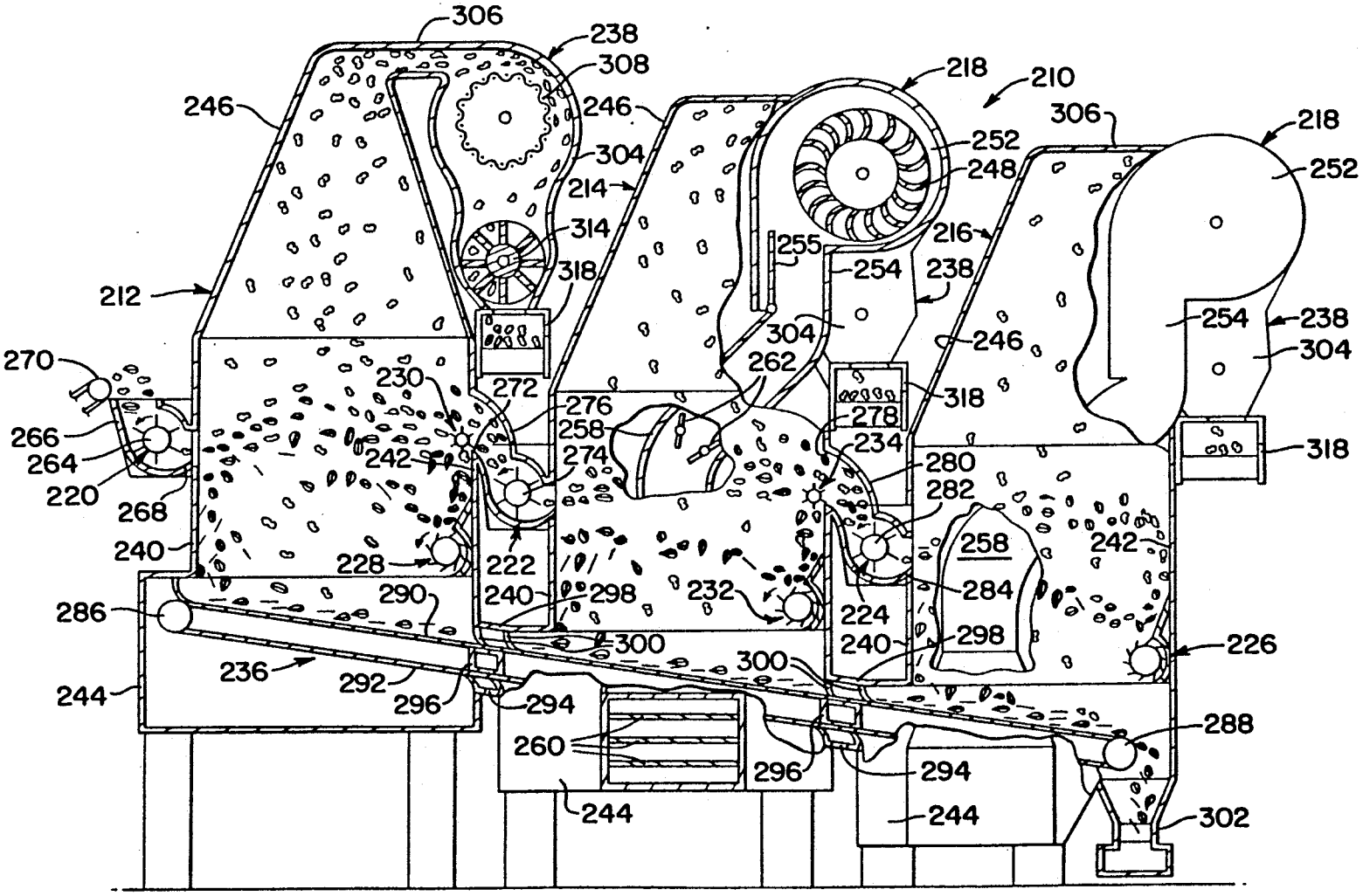
FIG. 6 is a view of another embodiment of an apparatus embodying the principles of the present invention, with certain parts broken away for purposes of clearer illustration.
Figure 7:
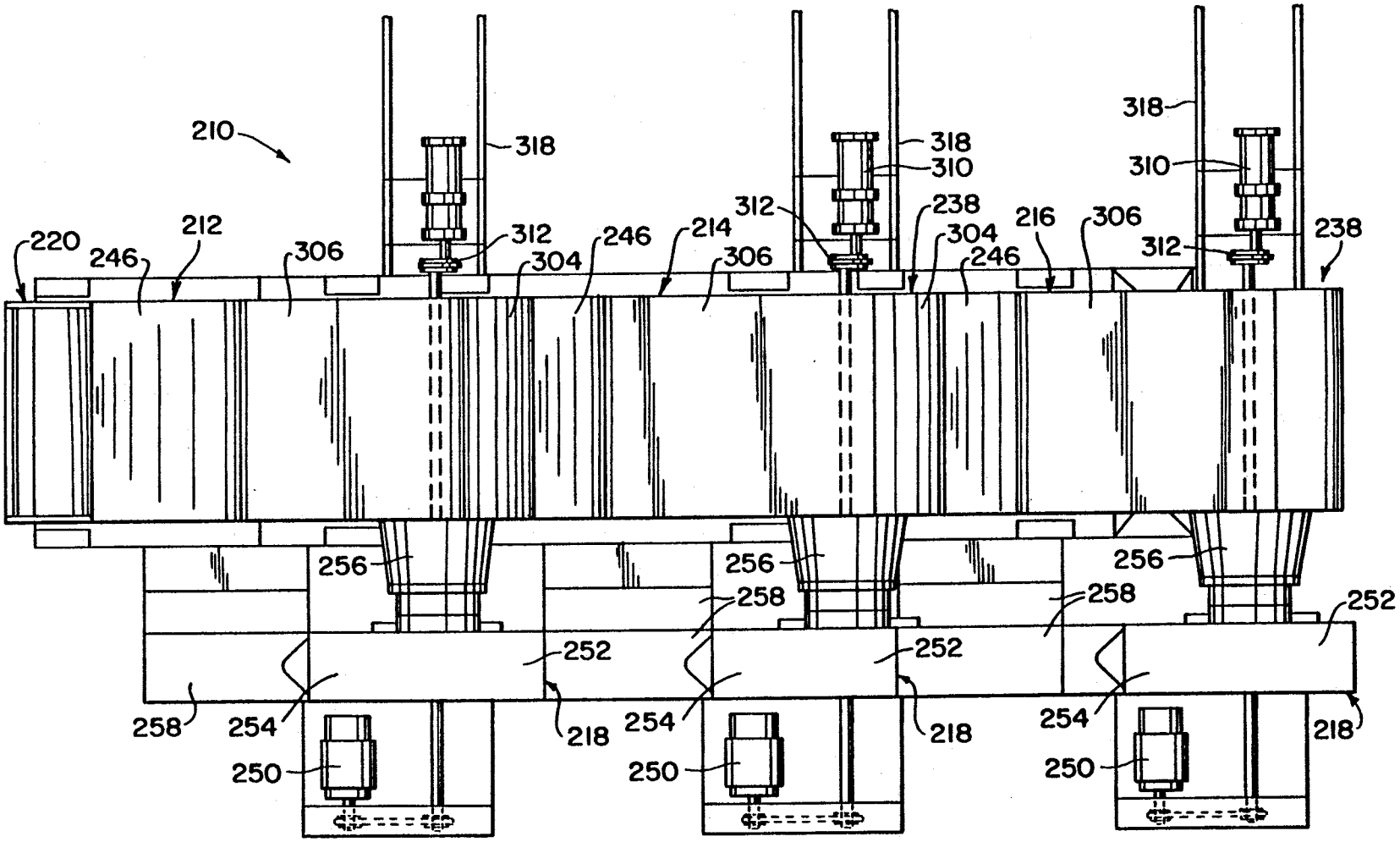
FIG. 7 is a top plan view of the apparatus shown in FIG. 6.
Figure 8:
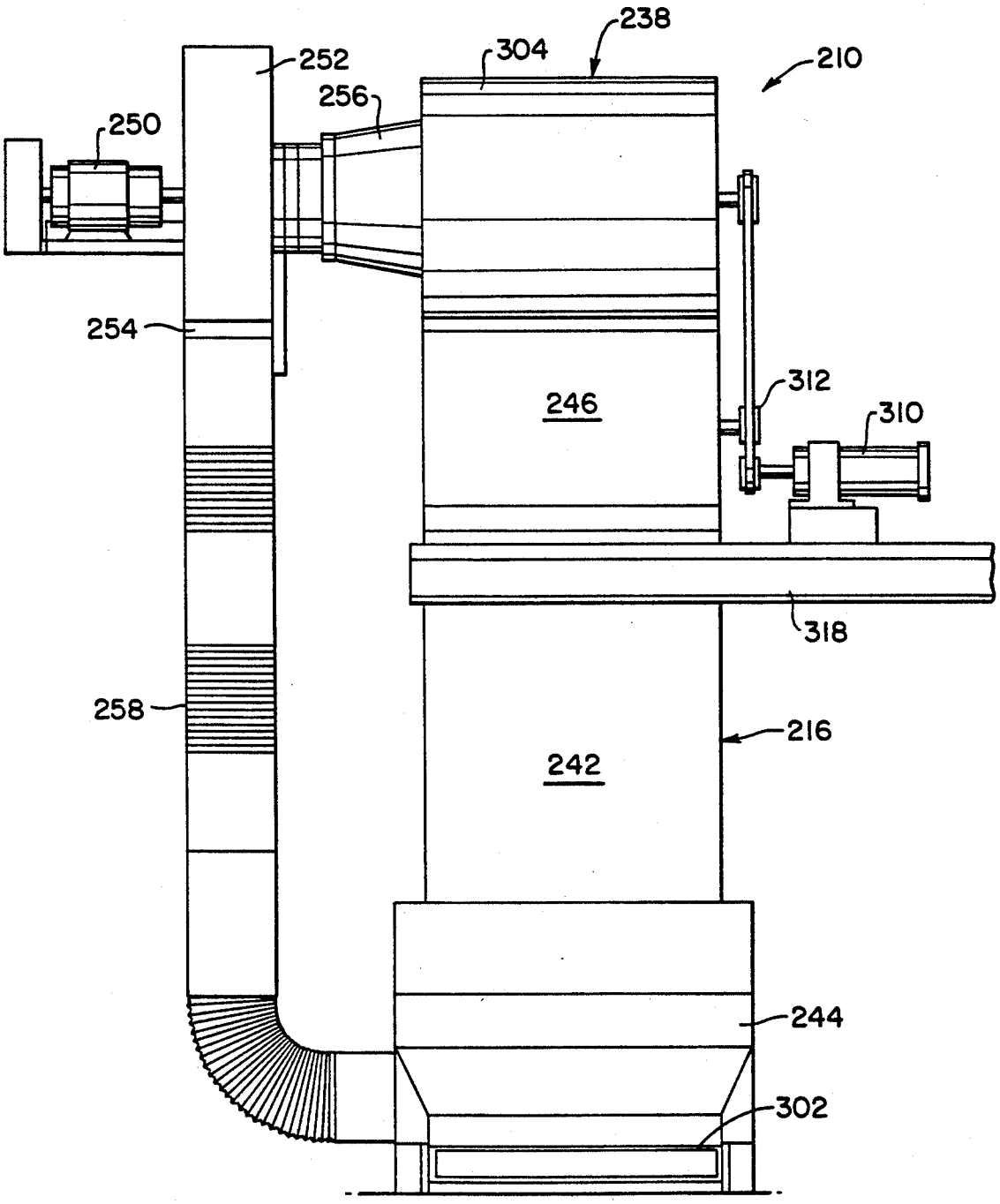
FIG. 8 is a rear end view of the apparatus shown in FIG. 6.
Figure 9:
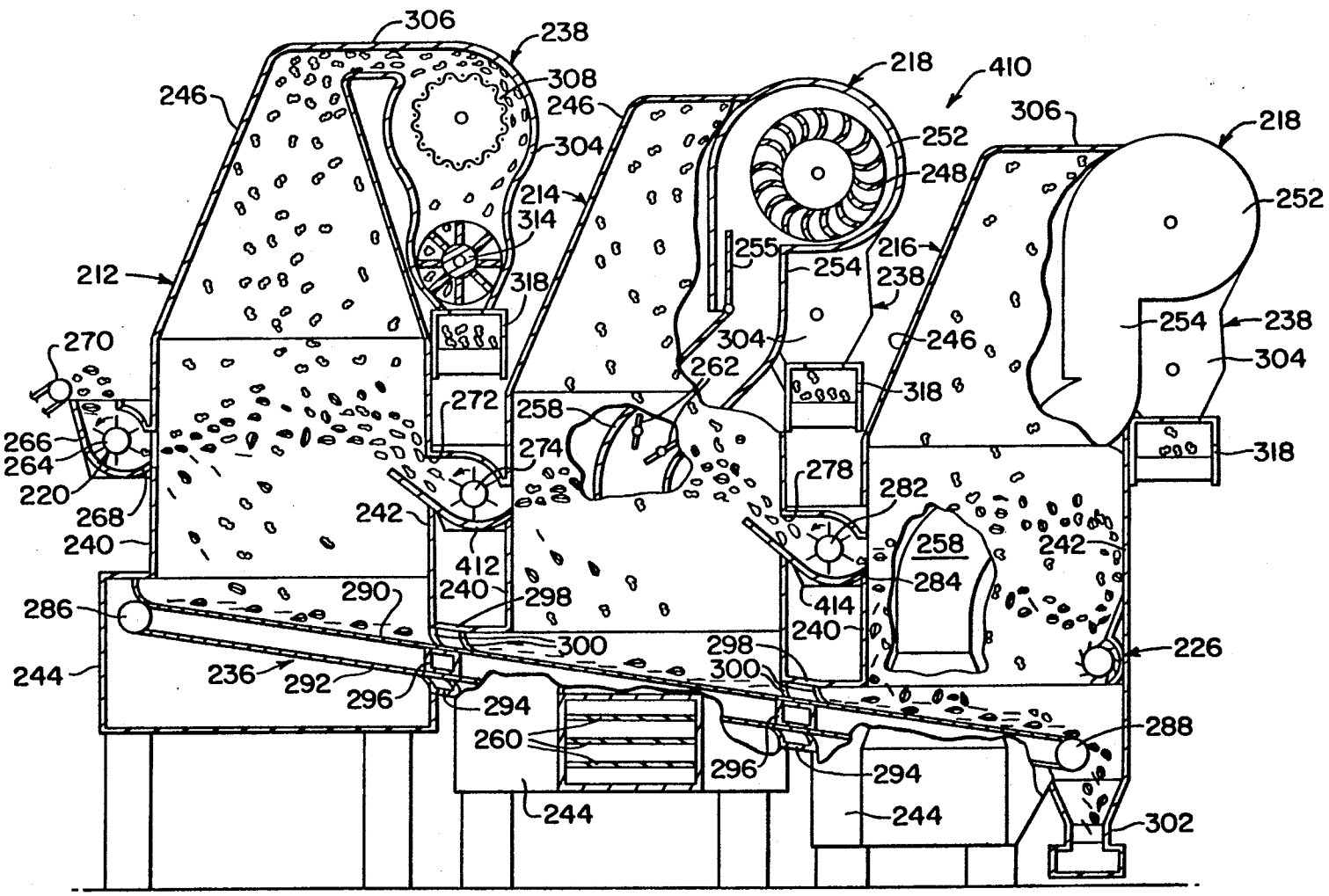
FIG. 9 is a view somewhat similar to FIG. 6 showing still another form of an apparatus embodying the principles of the present invention.

It will be noted that, since there is no upward flow of air in any of the exit chambers 94, there is no longer air flow bias maintaining the lamina in engagement with the downwardly facing surfaces of the operative flight of the endless foraminous conveyor 96 as is the case in the separating chambers 16. Consequently, as the lighter particles move into the exit chambers 94, these lighter particles are free to move downwardly by gravity from the operative flight within the associated exit chamber 94. Mounted in the bottom portion of each exit chamber is an endless conveyor 126 which includes an upper horizontally operative run on which the lamina are deposited. Each endless conveyor 126 is powered by a fixed speed motor 128 which serves to move the operative run in a direction to discharge the lamina supported thereon. Unloading may also be accomplished by conventional known centrifugal devices as shown in FIGS. 6 and 9.

The particles received downward within the outlet 36 of the device 12 which includes heavier particles and lighter particles which have not been carried upwardly within the separation chamber 16 and been received and discharged therefrom by the associated lighter particle receiving and discharging system 32 forms the threshed leaf tobacco supply for the device 14 which moves directly downwardly into the inlet 28 thereof for direction into cooperating relation with the projecting winnower assembly 30 thereof.

The arrangement whereby the particles discharging from the outlet 36 of the initial device 12 pass directly into the inlet 28 of the next adjacent device 14 ensures a minimum damage with respect to any lamina or lighter particles which pass with the heavier particles through the outlet 36 of the initial device 12.

Referring now more particularly to FIGS. 6–9 of the drawings, there is shown therein an apparatus, generally indicated at 210, for separating threshed leaf tobacco into (1) lighter particles such as lamina containing little or no stem, and (2) heavier particles such as lamina with attached stem or naked stems. The apparatus 210 includes a sheet metal structure providing three side-by-side separation chambers, generally indicated at 212, 214, and 216. While there are shown three separation chambers; namely, an initial end chamber 212, a middle chamber 214, and a final end chamber 216, it is within the contemplation of the present invention to provide two, or more than three separation chambers. A fan circulating system, generally indicated at 218, is associated with each separation chamber for establishing a generally upward flow of air within the associated separation chamber. The initial end chamber 212 has associated with a projecting side thereof a threshed leaf tobacco projecting mechanism, generally indicated at 220 which is operable to project threshed leaf tobacco from the projecting side of the chamber toward an opposite receiving side thereof, so that (1) a portion of the lighter particles is carried upwardly by the flow of air within the initial end chamber, (2) a portion of the heavy particles moves downwardly through the flow of air within the initial end chamber, and (3) the remaining particles pass to the opposite receiving side of the initial end chamber 212.

The middle chamber 214 includes a similar threshed leaf tobacco projecting mechanism, generally indicated at 222, for receiving the remaining particles which pass to the opposite receiving side of the initial end chamber 212, and projecting the same into the middle chamber 214 to be acted upon by the upward flow of air therein in a similar manner. The final end chamber 216 also includes a corresponding threshed leaf tobacco projecting mechanism, generally indicated at 224, which serves to project the remaining particles from the middle chamber 214 into the final end chamber 216.

Mounted in the opposite side of the final end chamber 216 is a reverse threshed leaf tobacco projecting mechanism or a reprojecting mechanism, generally indicated at 226, which is operable to receive the remaining particles passing to the opposite receiving side of the final end chamber 216 and to project them back across the generally upward flow of air therein in a path below the path of tobacco particles projected by the projecting mechanism 224 so that (1) remaining lighter particles are carried upwardly by the flow of air within the final end chamber 216, and (2) remaining heavier particles move downwardly through the flow of air within the final end chamber.

If desired, a similar reprojecting mechanism 228 may be provided in the initial end chamber 212 in a position spaced below the receiving position where the remaining tobacco particles projected by the projecting mechanism 220 are received prior to being projected by the middle projecting mechanism 222. If desired, a power driven rotary mechanism 230 may be mounted in the lower portion of the receiving entrance for the projecting mechanism 222. The purpose of the power driven rotary mechanism 230, which rotates in a clockwise direction as shown in FIG. 6, is to prevent tobacco particles from accumulating in the receiving entrance. The rotary mechanism 230 breaks up any clumps and tends to deliver the released particles into the projecting mechanism 222. All of the remaining tobacco particles projected by the projecting mechanism 220 which pass to the opposite receiving side of the initial chamber 212 which do not pass into the projecting mechanism 222 will be reprojected back across the upward flow of air in the initial end chamber in a path below the path which the tobacco particles projected by the projecting mechanism 222 take. The reprojected particles can contain some lighter particles that should have been carried upwardly during the initial pass across the air flow but for one reason or another were not, as, for example, because of clumping. The power driven nature of both the rotary mechanism 230 and reprojecting mechanism 228 tends to break up clumps thus freeing otherwise restrained lighter particles for movement upwardly by the air flow during the return pass.

A similar reprojecting mechanism 232 and rotary mechanism 234 may be provided in the middle chamber 214 as well. It will be understood that the reprojecting mechanisms 228 and 232 and the rotary mechanisms 230 and 234 are optional in the three unit apparatus 210 shown. The reprojecting means 226 in the final end chamber 216 is preferable but may also be eliminated if desired. Reprojection assumes a greater importance as the number of units is diminished.

A heavier particle receiving and discharging system, generally indicated at 236, is commonly provided in the lower end portions of all of the separation chambers 212, 214, and 216 for receiving the heavier particles therefrom. A lighter particle receiving and discharging system is also provided. However, as shown, the system consists of three lighter particle receiving and discharging mechanisms 238 of generally identical construction, in the upper end portions of the separation chambers 212, 214, and 216 respectively for receiving the lighter particles carried upwardly by the flow of air within each successive separation chamber and discharging the lighter particles therefrom.

The separation chambers may be formed of any desirable construction. Preferably, they are of substantially identical construction except for certain variations to be hereinafter more fully explained. In the drawings, the chambers are schematically illustrated to be formed of sheet metal. It will be understood that a rigid framework for retaining the sheet metal (not shown) normally would be provided. As shown, each chamber is of generally rectangular configuration, including a projecting side wall 240, and an opposite receiving side wall 242, with a lower end portion 244 being somewhat enlarged, and an upper end portion 246 being generally of upwardly tapering design configuration which aids in separating the lighter particles by increasing the velocity of the upward air flow as it passes therethrough.

The fan circulating or air flow establishing system 218 for each chamber may assume any desired configuration. As shown, each system includes a rotary centrifugal fan blade assembly 248 suitably journalled for rotational movement, by a variable speed motor assembly 250 about a horizontal axis within a fan housing 252 of conventional centrifugal fan configuration, that is, the fan housing 252 is in the form of side walls interconnected peripherally by an arcuate peripheral wall which extends somewhat less than 360° so as to provide for a tangential discharge 254 which constitutes the pressure side of the fan blade assembly 248. Regulating dampers may be installed in the discharge duct to control flow instead of fitting a variable speed motor.

As best shown in FIG. 6, the tangential discharge 254 includes a filtered exit controlled by a pivoted damper vane 255 which can be moved into different adjusted positions to control the amount of air circulated and to allow a certain amount to pass into the atmosphere preferably after being filtered. Instead of a pivoted damper vane, a fixed scoop may be provided to bleed-off about 10% of the recirculating air. The hollow central portion of each fan blade assembly 248 communicates directly with an axial inlet 256 of frustoconical design, the small diameter end of which is secured to one side of the fan housing 252 in interior communicating relation therewith.

The tangential discharge 254 of each fan blade assembly 248 is connected with a generally elongated angular duct section 258, the lower end of which curves inwardly and communicates interiorly with the lower end portion 244 of the associated separation chamber. As best shown in FIG. 6, three baffle plates 260 serve to distribute the air from the associated duct section 258 into the lower end portion 244 of the associated chamber so as to establish a generally upward flow of air within the chamber. In the arrangement shown, each duct section 258 has an adjustable damper 262 mounted in the central portion thereof.

The threshed leaf tobacco projecting mechanism 220 which is utilized in the projecting side wall 240 of the initial end chamber 214 is illustrated as including a paddle wheel type winnower assembly 264, which is rotatable about a transverse horizontal axis and suitably power-driven by a variable speed motor (not shown). It will be understood that other types of arrangements may be utilized such as described in U.S. Pat. No. 4,475,562.

As shown, the projecting side wall 240 has an inlet opening provided therein which cooperates exteriorly with a shroud structure 266 which leads to and is disposed in cooperating relation with the winnower assembly 264 so as to direct a tobacco particle supply into the winnower assembly 264 to be projected thereby. As shown, the shroud structure 266 is mounted in cooperating relation with the periphery of the winnower assembly 264 and a vane 268 is adjustably mounted about a horizontally extending axis in a position tangentially inwardly of the lower periphery of the winnower assembly 264 so that by adjusting the angle of the vane 268, the direction within the initial end chamber 212 across which the winnower assembly 264 projects the threshed leaf tobacco can be varied.

A suitable supply of threshed leaf tobacco, shown schematically at 270, is fed to the shroud structure 266 so that successive particles are picked up by the winnower assembly 264 and projected into the initial end chamber 212 for movement across the generally upward flow of air therein. The flow rate of the upward flow of air, which is separately controlled by the variable speed motor 250 and/or adjustable damper 262 associated with chamber 212, is such that lighter particles, such as lamina containing little or no stem, are carried upwardly by the air stream within the separation chamber, while heavier particles, such as lamina with attached stem or naked stems, move downwardly through the flow of air by gravity within the initial end chamber 212. In addition, a remaining portion of the particles moves to the opposite receiving side wall 242 where the particles pass through an opening 272 therein and are directed to the threshed leaf tobacco projecting mechanism 222 associated with the middle chamber 214 or to the reprojecting mechanism 228 below the opening 272. The reprojecting mechanism 228 is also preferably in the form of a paddle wheel rotary winnower which has a suitable backing plate structure operatively associated therewith. The rotary device 230 is also preferably in the form of an unshrouded smaller power-driven rotary paddle winnower.

The projecting mechanism 222 of the middle chamber 214 consists essentially of a paddle wheel type winnower assembly 274, variable speed power-driven about a horizontally extending transverse axis within a shroud structure 276 which extends in enclosing relation from the opening 272 in the receiving side wall 242 of the middle chamber 214 in cooperating relation with respect to the winnower assembly 224, and there is also provided a vane 276 which is movable about a horizontally extending axis parallel with the axis of the winnower. The vane 276 and variable speed drive for the winnower 274 can be adjusted to adjust the direction and velocity which the remaining particles are projected into the associated chamber 214 so that as the particles move across the generally upward flow of air therein, the lighter particles will be carried upwardly by the flow of air, which is separately controlled as before, into the upper portion of the chamber, and the heavier particles will be moved downwardly by gravity through the flow of air into the lower portion of the separation chamber, while a remaining portion of the particles will move across the chamber to the opposite side wall 242 which likewise is provided with a similar opening 278 which, in turn, connects with a similar shroud structure 280 containing a similar winnower assembly 282 with a similar vane 284 for projecting the tobacco particles received across the final end chamber 216. Also, as before, the remaining particles received at the receiving side wall 242 which do not pass through the opening 278 or are assisted therein by rotary device 234 are led into the reprojecting mechanism 232, which serves to project the tobacco particles back across the central chamber 214 in a path below the projection path of the projecting mechanism 220 thereof.

At the opposite side wall 242 of the final end chamber 216, the remaining particles are received by the reprojecting mechanism 226. Here, again, the reprojecting mechanism 226, like the reprojecting mechanism 232 of the central chamber 214, is preferably in the form of a variable speed power-driven paddle wheel winnower assembly rotatable about a horizontal axis adjacent the opposite receiving side wall 242 having a backing plate in a position to receive the remaining particles which have passed to the receiving side wall 242 and to project the same back across the final end chamber 216 so that the particles will be separated in the manner previously indicated with the lighter particles moving upwardly and the heavier particles moving downwardly.

The heavier particle receiving and discharging system 236 comprises essentially an endless perforated or foraminous conveyor assembly which may be of any conventional design and includes an initial end roller 286 mounted in the lower end portion 244 of the initial end chamber 212 at a position adjacent the projecting side wall 240 thereof, and a final roller 288 disposed in the lower portion of the final end chamber 216, in a position spaced slightly from the receiving side wall 242 thereof. The endless perforated or foraminous conveyor assembly 236 includes an endless foraminous belt providing upper operative flight 290 extending through the lower portion of all of the chambers from the roller 286 to the roller 288, and a parallel lower return flight 292 extending from the roller 288 to the roller 286.

The endless foraminous conveyor 236 extends between adjacent chambers by means of barrier assemblies, each of which includes a flapped lower wall 294 extending below the lower return flight 292, a central boxlike barrier 296 extending between the upper and lower flights 290 and 292, a flapped upper wall 298 spaced above the upper operative flight 290, and a pair of flexible flaps 300 extending downwardly from the ends of each upper wall 298. The conveyor assembly 236 includes a suitable driving motor (not shown), so that the upper operative flight 290 moves from the roller 286 toward the roller 288, and the return flight moves in the opposite direction.

It can be seen that heavier particles which fall by gravity through the upward flow of air in each of the separation chambers will come to rest on the upwardly facing surfaces of the upper operative flight 290 of the endless foraminous conveyor assembly 236. The flaps 300 allow the upper operative flight 290 and heavier particles carried thereby to move between adjacent chambers, while preventing flow of air between adjacent chambers. It will be noted that heavier particles will be discharged as they move with the upper operative flight 290 over the roller 288, discharging the particles downwardly through a discharge chute 302. Lighter particles previously trapped or shadowed by heavier particles may have a third chance of moving upward from the fluidizing effect above the conveyor 236.

The lighter particle receiving and discharging system could be the same as the system 32 of the apparatus 10. However, FIGS. 6–9 illustrate an alternative system in the form of three separate mechanisms 238 such as known screening separators or tangential separators. As shown, each mechanism 238 includes a screening chamber 304 of generally cylindrical construction having a narrow Venturi-like inlet 306 which extends tangentially from the extremity of the upper end 246 of the associated chamber into the upper end of the screening chamber 304. Rotatably mounted in the screening chamber is a cylindrical screen assembly 308, one interior end of which is communicated through an associated screening chamber end wall with the suction side of the associated frustoconical axial fan inlet 256. In this way, the upward flow of air in each chamber is caused to flow through the tangential inlet 306 at the upper end 246 thereof, into the screening chamber 304, through the rotary screen assembly 308 and then axially through the fan inlet 256 to be recirculated.

The screening separator acts like a horizontal cyclone. The centrifugal force causes most of the solid particles to hug the peripheral wall and discharge through the airlock. Only light particles which remain in suspension contact the rotary screen.

The lighter tobacco particles carried by the air flow into the screening chamber 304 are prevented from being recirculated with the air by the cylindrical screen assembly 308. The screen assembly 308 is rotated as by a motor 310 and a suitable motion transmitting assembly 312 at a speed sufficient to cause any tobacco particles which engage the periphery of the screen assembly 308 by virtue of the air flow to be thrown by centrifugal action therefrom to the interior periphery of the screening chamber wall which directs them downwardly to a rotary plug or particle discharging mechanism 314 rotatably mounted in the lower portion of the screening chamber.

The rotary discharging mechanism which is driven by a suitable motion transmitting assembly by the motor 310 serves the dual function of preventing air suction from the exterior of the screening chamber 308 while at the same time allowing and, indeed, positively assisting the tobacco particles directed downwardly in the screening chamber 308 to exit exteriorly therefrom. As shown, a conveyor assembly 318 receives the lighter tobacco particles discharged from the screening chamber 308 and conveys them to a point of further use or handling.

Referring now more particularly to FIG. 9, there is shown therein another form of apparatus 410 embodying the principles of the present invention. The apparatus 410 is like the apparatus 210 in most respects and, consequently, parts of the apparatus 410 which correspond substantially identically with corresponding parts of the apparatus 210 are given corresponding reference numerals and will not be specifically described. Instead, the description of the apparatus 410 will be limited to the areas of modification and change which are embodied therein with respect to the apparatus 210. A primary change is that the apparatus 410 illustrates the option of the apparatus 210 where the reprojecting mechanisms 228 and 232 in the initial end chamber 212 and the central chamber 214 respectively are eliminated together with the associated rotary devices 230 and 234. It will be noted that, in conjunction with the elimination of these mechanisms, modified shroud structures 412 and 414 are provided instead of the configuration of the shroud structures 276 and 280 previously provided. As shown, the shroud structures 412 and 414 are more similar to the construction of the initial end chamber shroud structure 266 with the upper lead in portion essentially eliminated. Moreover, it will be noted that the shroud structures 412 and 414 extend from a position within the associated chambers 210 and 214 through the associated openings 272 and 278. However, rotary devices 230 and 234 may be installed on tip of extended shroud to eliminate leaves draping over this extension.

It will be understood that, in the operation of the apparatus 410, most of the remaining particles which move across the initial end chamber 210 will pass through the opening 272 and into the projecting winnower 274 cooperating with shroud structure 412 and those particles which may reach the receiving side wall 242 below the opening 272 may be discharged on the large particle endless conveyor flight 290. Any light particles which are accidentally deposited on the conveyor flight 290 in a free condition may be moved upwardly in the chamber 214. Similarly, the operation of the projecting winnower 282 cooperating with shroud structure 412 is such that most of the remaining tobacco particles moving across the middle chamber 214 will be received within the opening 278 with any others therebelow being handled by the operative conveyor flight 290.

It will be seen that the objects of this invention have been fully and effectively accomplished. It will be realized that the foregoing preferred specific embodiment has been shown and described for the purpose of this invention and is subject to change without departure from such principles. This invention includes all modifications encompassed within the spirit and scope of the following claims.

What is claimed is:

1. A method of separating lighter particles from heavier particles in a mixture thereof utilizing a plurality of successive side-by-side separation chambers for continuous movement of particles therethrough from an initial end chamber downstream to a final end chamber, each of said chambers having a pair of opposite sides one of which is a projecting side and one of which is a receiving side with the receiving side of each chamber upstream of said final end chamber having an opening therein which is disposed in immediate feed communicating relation with the projecting side of the next downstream chamber, said method comprising the steps of establishing a generally upward air flow in each of said plurality of separation chambers between the opposite sides thereof, projecting particles from the projecting side of each chamber into and across the generally upward air flow therein so that lighter particles are carried upwardly by the generally upward air flow in each chamber and particles including heavier particles move downwardly through the generally upward air flow in each chamber, the particles projected from the projecting side of said initial end chamber being the lighter and heavier particles of the mixture, causing some of the particles projected from the projecting side of each chamber upstream of aid final end chamber to reach the receiving side thereof and to pass through the opening therein to immediately become particles projected from the projecting side of the next downstream chamber into and across the generally upward air flow in the next downstream chamber, receiving the lighter particles carried upwardly by the air flow within said chamber and moving the same in such a way as to enable them to be discharged from the chambers, and receiving the particles including heavier particles which move downwardly within the generally upward air flow in said chambers and moving the same in such a way as to enable them to be discharged from the chambers.

2. A method as defined in claim 1 wherein said mixture comprises threshed leaf tobacco.

3. A method as defined in claim 2 wherein the particles including said heavier particles which move downwardly through the generally upward air flow in each chamber upstream of the final end chamber are received in each upstream chamber and moved in such a way as to be discharged into the opening in the receiving side of each upstream chamber to immediately become particles projected from the projecting side of the next downstream chamber, the particles including said heavier particles which move downwardly through the generally upward air flow in said final end chamber being received therein and moved in such a way as to be discharged through an outlet at the receiving side thereof.

4. Apparatus for separating lighter particles from heavier particles in a mixture thereof which comprises a plurality of successive side-by-side separation chambers constructed and arranged to enable particles to be continuously moved therethrough from an initial end chamber downstream to a final end chamber, each of said chambers having a pair of opposite sides one of which is a projecting side and one of which is a receiving side with the receiving side of each chamber upstream of said final end chamber having an opening therein in immediate feed communicating relation with the projecting side of the next downstream chamber, a fan system constructed and arranged with respect to said chambers to establish a generally upward air flow in each of said plurality of separation chambers between the opposite sides thereof, a power driven particle projecting mechanism associated with each chamber disposed in the projecting side of the associated chamber, the power driven particle projecting mechanism associated with the initial end chamber being constructed and arranged to project particles of a mixture fed thereto into and across the generally upward air flow in the initial end chamber so that lighter particles are carried upwardly by the generally upward air flow within the initial end chamber and some particles including heavier particles move downwardly within the generally upward air flow in the initial end chamber, the power driven particle projecting mechanism associated with each chamber downstream of said initial end chamber being constructed and arranged to project particles fed thereto into and across the generally upward air flow in the associated downstream chamber so that lighter particles are carried upwardly by the generally upward air flow within the associated downstream chamber and some particles including heavier particles move downwardly within the generally upward air flow in the associated downstream chamber, the power driven particle projecting mechanism associated with each chamber downstream of said initial end chamber being constructed and arranged with respect to the adjacent upstream chamber so as to be disposed in immediate feed communicating relation with said opening in the receiving side of the adjacent upstream chamber, the power driven particle projecting mechanism associated with each chamber upstream of said final end chamber being constructed and arranged to project the particles fed thereto into and across the generally upward air flow in each upstream chamber in such a way that some particles reach the receiving side of each upstream chamber in a position to enter the opening therein in immediate feed communicating relation with the adjacent downstream power driven particle projecting mechanism so as to be immediately projected thereby into and across the generally upward air flow in the chamber associated therewith, a lighter particle receiving and moving assembly constructed and arranged with respect to said chambers to receive the lighter particles carried upwardly by the generally upward air flow within said chambers and move the same in such a way as to enable the lighter particles to be discharged from said chambers, and a heavier particle receiving and moving assembly constructed and arranged with respect to said chambers to receive the particles including heavier particles which move downwardly within the generally upward air flow in said chambers and move the same in such a way as to enable them to be discharged from the chambers.

5. Apparatus as defined in claim 4 wherein said heavier particle receiving and moving assembly comprises an operative extent of an endless foraminous conveyor in each chamber movable in a direction from the projecting side thereof toward the receiving side thereof.

6. Apparatus as defined in claim 5 wherein the generally upward air flow in each chamber flow upwardly through the operative extent of the endless foraminous conveyor movable therein.

7. Apparatus as defined in claim 6 wherein the operative extent of the endless foraminous conveyor in each chamber constitutes an upper flight of a separate endless foraminous conveyor in each chamber, the separate endless foraminous conveyor in each chamber upstream of the final end chamber being constructed and arranged such that the upper flight moves the particles received thereon in such a way as to be discharged into said opening in the receiving side thereof, the separate endless foraminous conveyor in said final end chamber being constructed and arranged such that the upper flight moves the particles received thereon in such a way as to be discharged into an outlet at the receiving side thereof.

8. Apparatus for separating lighter particles from heavier particles in a mixture thereof which comprises means defining a plurality of successive side-by-side separation chambers for continuous movement of particles therethrough from an initial end chamber downstream to a final end chamber, each of said chambers having a pair of opposite sides one of which is a projecting side and one of which is a receiving side with the receiving side of each chamber upstream of said final end chamber having an opening therein in immediate feed communicating relation with the projecting side of the next downstream chamber, means for establishing a generally upward air flow in each of said plurality of separation chambers between the opposite sides thereof, power driven projecting means in the projecting side of said initial end chamber for projecting the particles of a mixture fed thereto into and across the generally upward air flow in the initial end chamber so that lighter particles are carried upwardly by the generally upward air flow within the initial end chamber and some particles including heavier particles move downwardly within the generally upward air flow in the associated chamber, the particles fed to the particle projecting means in the projecting side of the initial end chamber being the particles of a mixture of lighter and heavier particles, power driven projecting means in the projecting side of each chamber downstream of said initial end chamber for projecting particles fed thereto into and across the generally upward air flow in the associated downstream chamber so that lighter particles are carried upwardly by the generally upward air flow within the associated downstream chamber and some particles including heavier particles move downwardly within the generally upward air flow in the associated downstream chamber, said side-by-side separation chambers being arranged so that the power driven projecting means in the projecting side of each chamber downstream of said initial end chamber is disposed in immediate feed communicating relation with said opening in the receiving side of the adjacent upstream chamber, the power driven projecting means in each chamber upstream of said final end chamber being operable to project the particles fed thereto into and across the generally upward air flow in each upstream chamber in such a way that some particles reach the receiving side of each upstream chamber in a position to enter the opening therein in immediate feed communicating relation with the adjacent downstream power driven projecting means so as to be immediately projected thereby into and across the generally upward air flow in the next downstream chamber, lighter particle receiving and moving means for receiving the lighter particles carried upwardly by the generally upward air flow within said chamber and moving the same in such a way as to enable the lighter particles to be discharged from said chambers, and heavier particle receiving and moving means for receiving the particles including heavier particles which move downwardly within the generally upward air flow in said chambers and for moving the same in such a way as to enable them to be discharged from the chambers.

9. Apparatus as defined in claim 8 wherein said heavier particle receiving and moving means comprises an operative extent of an endless foraminous conveyor in each chamber movable in a direction from the projecting side thereof toward the receiving side thereof.

10. Apparatus as defined in claim 9 wherein the generally upward air flow in each chamber flows upwardly through the operative extent of the endless foraminous conveyor movable therein.

11. Apparatus as defined in claim 10 wherein the operative extent of the endless foraminous conveyor in each chamber constitutes an upper flight of a separate endless foraminous conveyor in each chamber, the separate endless foraminous conveyor in each chamber upstream of the final end chamber being operable such that the upper flight moves the particles received thereon in such a way as to be discharged into said opening in the receiving side thereof, the separate endless foraminous conveyor in said final end chamber being operable such that the upper flight moves the particles received thereon in such a way as to be discharged into an outlet at the receiving side thereof.

* * * * *